US005365685A

United States Patent [19]

Shank

[11] Patent Number: 5,365,685

[45] Date of Patent: Nov. 22, 1994

[54] AERIAL ADVERTISING WIND TUBE

[76] Inventor: Lynn D. Shank, 619 N. Park, Valley Center, Kans. 67147

[21] Appl. No.: 45,619

[22] Filed: Apr. 9, 1993

[51] Int. Cl.[5] ..... G09F 21/06; G09F 21/12

[52] U.S. Cl. ..... 40/212; 40/215; 40/217; 40/604; D10/59

[58] Field of Search ..... 40/212, 215, 217, 477, 40/604, 214; 73/170.05; D10/59

[56] References Cited

U.S. PATENT DOCUMENTS

| | | | |
|---|---|---|---|
| D. 328,872 | 8/1992 | Sutton | D10/59 |
| 1,401,626 | 12/1921 | Mader | D10/59 |
| 1,794,828 | 3/1931 | Bleriot | 40/215 |
| 1,973,205 | 9/1934 | Gordon | 40/215 |
| 2,238,875 | 4/1941 | Manson | 40/215 |
| 2,238,876 | 4/1941 | Manson . | |
| 2,252,764 | 8/1941 | Farrell | 40/604 |
| 2,270,884 | 1/1942 | Manson | 40/215 |
| 3,071,892 | 1/1963 | Clark | 40/215 |
| 4,178,706 | 12/1979 | Boyce | 40/215 |
| 4,558,862 | 12/1985 | Kelly | D10/59 |
| 4,624,648 | 11/1986 | Waters | 73/170.05 |
| 4,669,304 | 6/1987 | Caragata | D10/59 |
| 4,730,488 | 3/1988 | David | D10/59 |
| 5,026,073 | 6/1991 | Luttrell et al. . | |

FOREIGN PATENT DOCUMENTS

| | | | |
|---|---|---|---|
| 627677 | 10/1927 | France | 73/170.05 |
| 2682797 | 4/1993 | France | 40/215 |

*Primary Examiner*—Richard A. Bertsch
*Assistant Examiner*—Howard R. Richman
*Attorney, Agent, or Firm*—Edward L. Brown, Jr.

[57] ABSTRACT

A lightweight wind tube utilized for advertising, constructed of fabric with a constant diameter having annular sleeve at each end. The forward end sleeve being held in an open circle by flexible frame members with furled ends which are positioned in lateral openings in the forward end sleeve to provide attachment points for mounting yoke strings and access for disassembly. The wind tube further includes a rear sleeve formed in the exit end of the tube including a string for adjusting the choke in the exit end of the tube.

6 Claims, 1 Drawing Sheet

AERIAL ADVERTISING WIND TUBE

BACKGROUND OF THE INVENTION

Previous aerial advertising devices, all of which have been towed by aircraft, have been concerned with two major areas. The first is the ease of storage and set up, and the second is the stability of the body of the device during actual use.

Prior aerial devices, such as banners, which can be rolled up for storage, have utilized simple tubes running the length of the banner, so as to give added rigidity to the device during use, as typified in U.S. Pat. No. 1,794,828.

Other aerial advertising devices, as illustrated in U.S Pat. No. 1,973,205, have consisted of various desired shapes constructed around a tapered tubular wind tunnel with a fixed restricting choke in the aft end of the device, which increased drag and gave the device a more horizontal appearance when towed behind a fast moving airplane.

Wind velocities often caused the outer surfaces of a tubular aerial device to flutter and oscillate when towed behind a fast moving airplane, which diminished desired visual impact. As shown in U.S. Patent No. 2,238,876, a rigid but somewhat bendable set of copper wire convolutions held the front end in an open position. Wire mesh, placed across the opening of the aft end providing a fixed choke, results in greater stability of the device side walls during use.

A later method of reducing the flutter and oscillation of an aerial device side walls, when towed by a fast moving airplane, was achieved when a mesh or net fabric was used for the entire body of the aerial device, as illustrated in U.S. Pat. No. 5,026,073. In this particular patent, an adjustable choke was also used to vary the intensity and amount of air which passed through the side mesh walls of the device.

SUMMARY OF THE INVENTION

The present invention relates to an improved stationary air tube advertising device used on flag poles or flown from kites. It provides a self inflatable tubular and elongated shaped body, that can be made of a material such as cloth fabric or plastic, with the front end of the body fitted on a collapsible framework. The framework includes at least one flexible rod, with the rod ends being positioned in such a way that the length of the rod, or rods, form a closed circular shape frame. The entry end is able to receive air that passes through the body and exits at the exit end of the invention. The exit end has an adjustable choke that maintains a constant level of inflation during normal ground level wind speeds, with a minimum of flutter and oscillation, without the use of mesh or netting.

It is therefore the principal object of the present invention to provide a new and improved air tube that utilizes an adjustable choke to maintain a desired stable inflation in a variety of wind speeds.

Another object of the invention is to provide an air tube with a circular front end frame that may be easily disassembled and compactly stored with the body of the air tube.

Another object of the invention is to provide an air tube construction that is sturdy enough to handle the stress received from high wind speeds, yet has a sufficiently light weight to allow it to function properly in wind velocities as low as four miles per hour, or six kilometers per hour.

These and other important objects of the present invention are specifically set forth or will become apparent from the following detailed description of the preferred embodiments of the invention, when read in conjunction with the accompanying drawings, wherein.

DETAILED DESCRIPTION OF THE INVENTION

Figure 1:
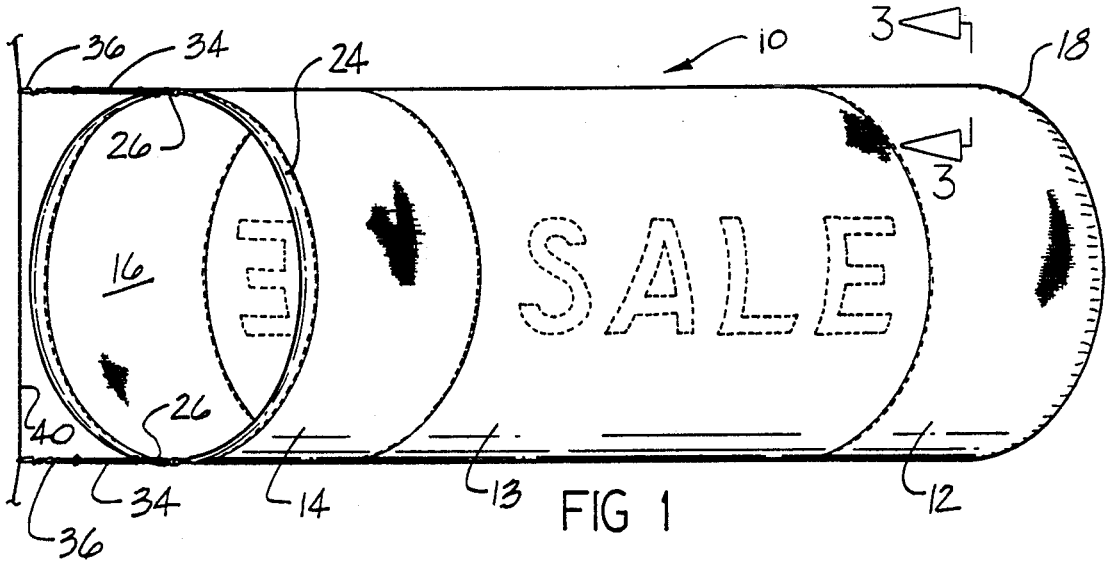
FIG. 1 is a perspective view from the left side of the invention showing attachment lines attached to a flag pole rope.
Figure 2:
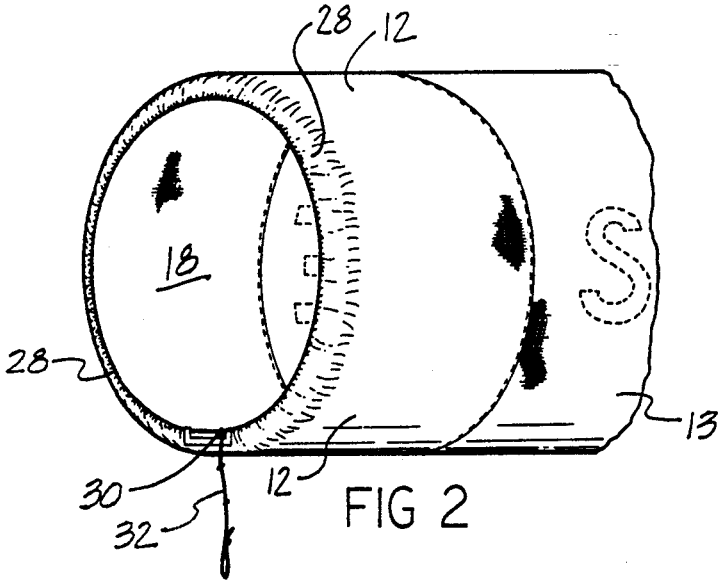
FIG. 2 is a perspective view of the aft end of the air tube, showing the adjustable choke in a full, inflated position.
Figure 3:
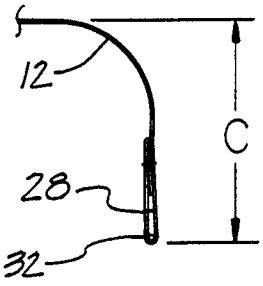
FIG. 3 is a partial sectional view, to an enlarged scale, of the adjustable choke at the aft end of the windsock body, and the folded over seam defining the annular sleeve.

A wind tube, generally described by reference number 10, is constructed of a material such as lightweight plastic or cloth material, of sufficient weave or density so as to restrict air from filtering through it. Various high strength synthetic materials and colors may be used to create bands or patterns on various areas 12, 13, and 14, which combine to form a visually appealing body design.

The wind tube 10, has an entry end 16, for receiving air into the interior of the device, and an exit end 18, for the exhaust of the received air. The size of the wind tube 10, can vary in length from three feet to fifteen feet with a diameter proportioned to the length.

The entry end 16, is folded over and seamed to form an annular sleeve 24, with at least two lateral openings 26, in which two flexible rods 20, and 20', are positioned. The ends of the flexible rod 20, are fixed so that a closed loop frame is formed by the rods. If more than one rod is utilized, each rod will form a portion of the overall circle frame 21 defining the entry end 16.

Attached to the end of each rod 20, is a ferrule 22 for engagement, with the opposite end of an adjacent rod 20'. The ferrule tube 22, is positioned in a lateral opening 26, which allows for easy access for assembly and disassembly of the frame 21, in the sleeve 24.

The exit end 18 of the wind tube, is folded over and seamed to form a second annular sleeve 28, with a cut out opening 30. A choke string 32, is placed within the annular sleeve 28, with both ends extending through the opening 30. The first end of the choke string passes through a loop located on the second end. The choke string 32 has a series of knots along its length, which the loop, when tightened, will not pass. Moving the loop over adjacent knots allows the circumference of exit end to be adjusted so that the choke on the wind tube 10 can be varied to suit the amount of wind. If the wind is 25 miles per hour, the choke is opened to a distance C of, for example two inches on a fifty-four inch diameter wind tube or six inches in very low winds.

Figure 4:
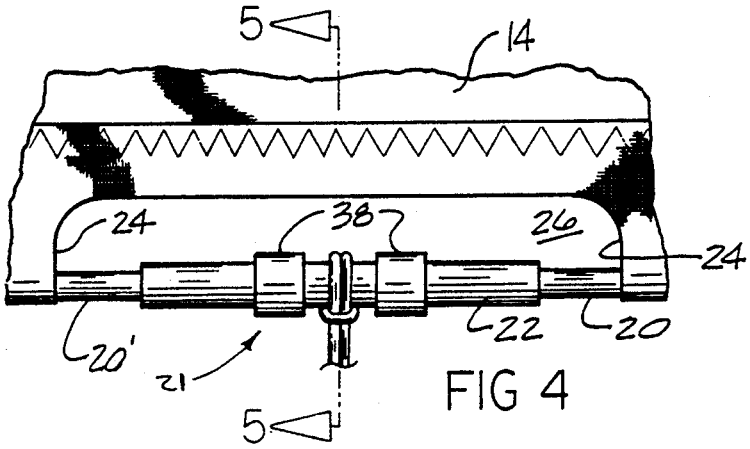
FIG. 4 is a view of the positioning and holder for the flexible rod ends and a partial view of the front end edge taken along line 3—3 of FIG. 1.
Figure 5:
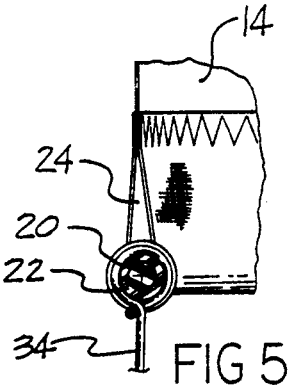
FIG. 5 is a partial sectional view taken along line 5—5 of FIG. 4.

As shown in FIG. 1, two bridle yokes 34 are attached to the wind tube, preferably at the ferrule tube 22, as shown in FIG. 4. The bridle yokes 34, is then attached to any object desired, such as a flag pole rope 40, using a releasable clasp 36. The number of bridle yokes 34 can vary. However, the two string configuration of FIG. 1 is sufficient with a fourteen foot wind tube.

OPERATION

The wind tube 10 described can be stored until use in a minimum of space. The wind tube 10, will lie flat with the two lateral openings 26, at the opposite corners and the two rods 20, and 20' in the perspective sleeves 24. The wind tube can then be rolled up on the rods 20.

To assemble the frame 21, of the wind tube 10, the rods are bent in an actuate shape so that the ferrule 22, on one rod, is aligned and engages with the free end of the other rod. Then, the opposite ends of rods 20 and 20' are bent into a circle and the remaining ferrule is inserted over the free end, with the frame 21, assembled in a circular shape. The two yoke strings 34, are then attached directly to a pole or to a flag pole rope, as shown in FIG. 1 and elevated into position.

The adjustable choke would be set to the desired setting, taking into account the approximate wind speed, so as to maximize stable inflation of the body of the tube 10.

The desired visual effect is achieved when the tube acquires a stable inflation. Lettering, of either a permanent or temporary nature, which has been placed onto the material forming the body of the tube, is then visible to observers.

Having described the invention with sufficient clarity that those skilled in the art may make and use it, what is claimed as new and desired to be secured by Letters Patent is:

1. An adjustable choke wind tube utilized for attachment to a substantially vertical line in a stationary position, comprising:

an elongated air inflatable tube constructed of fabric with a substantially constant diameter having an open entry end and an exit end; the entry end being formed with a first annular sleeve there around and a pair of lateral openings therein; the exit end being formed with a second annular sleeve there around;

a circular frame means positioned in the first annular sleeve for maintaining the entry end of the wind tube, the frame including at least one removable flexible rod with connecting means on the ends thereof;

a string means positioned in the second annular sleeve forming an adjustable loop for adjusting the choke in the exit end of the tube to accommodate different wind velocities and maintain constant pressure within the tube.

2. An adjustable choke wind tube as set forth in claim 1 including: a pair of bridles, each attaching to the frame at the lateral openings in the tube, the bridles being oppositely spaced on the circular frame means whereby the wind tube is prevented from rotation in the wind.

3. An adjustable choke wind tube as set forth in claim 1, wherein the circular frame means includes at least two flexible rods with ferrule connecting means on the ends thereof.

4. An adjustable choke wind tube as set forth in claim 1, wherein the ratio of the length of the wind tube to its diameter is greater than 2 to 1.

5. An adjustable choke wind tube as set forth in claim 1, wherein the ratio of the radius of the wind tube, to the choke is in a range of between 3 to 1 to 15 to 1.

6. An adjustable choke wind tube as set forth in claim 1, wherein the ratio of the radius of the wind tube to the choke is substantially 5 to 1.

* * * * *